US010201189B1

(12) United States Patent
Qiu

(10) Patent No.: US 10,201,189 B1
(45) Date of Patent: Feb. 12, 2019

(54) ATOMIZATION CORE DEVICE AND ELECTRONIC CIGARETTE

(71) Applicant: Joyetech Europe Holding GmbH, Zug (CH)

(72) Inventor: Weihua Qiu, Jiangsu (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 22 days.

(21) Appl. No.: 15/667,124

(22) Filed: Aug. 2, 2017

(51) Int. Cl.

| | |
|---|---|
| ***A24F 13/00*** | (2006.01) |
| ***A24F 47/00*** | (2006.01) |
| ***H05B 3/44*** | (2006.01) |
| ***F22B 1/28*** | (2006.01) |

(52) U.S. Cl.
CPC ..... *A24F 47/008* (2013.01); *F22B 1/284* (2013.01); *H05B 3/44* (2013.01)

(58) Field of Classification Search
CPC ..... A24F 47/002; A24F 47/008; F22B 1/284; H05B 3/44
USPC ..... 131/328, 329
See application file for complete search history.

(56) References Cited

U.S. PATENT DOCUMENTS

2013/0125906 A1* 5/2013 Hon ..... A24F 47/008 131/329
2015/0181943 A1* 7/2015 Li ..... H05B 3/48 131/329
2015/0296889 A1* 10/2015 Liu ..... A24F 47/008 131/329
2015/0305408 A1* 10/2015 Liu ..... H05B 3/44 131/329
2016/0192708 A1* 7/2016 DeMeritt ..... H05B 3/40 131/329
2016/0374397 A1* 12/2016 Jordan ..... A24F 47/008 131/329
2018/0140018 A1* 5/2018 Hu ..... H05B 3/44
2018/0199631 A1* 7/2018 Chen ..... A24F 47/008
2018/0263294 A1* 9/2018 Qiu ..... A24F 47/00

* cited by examiner

*Primary Examiner* — Hae Moon Hyeon
(74) *Attorney, Agent, or Firm* — Novick, Kim & Lee, PLLC; Allen Xue

(57) ABSTRACT

An atomization core device has an electrode column, a liquid guiding element and a heating wire. The electrode column has a hollow liquid storage chamber. A peripheral wall of the electrode column is provided with a through-hole in communication with the liquid storage chamber. The liquid guiding element and the heating wire wrap around the outer periphery of the electrode column, and the liquid guiding element covers the through-hole. The atomization core can reduce the carbon deposition, increase the life of the heating wire, keep the original taste of the tobacco liquid, and reduce the occurrence of dry heating and leakage.

18 Claims, 5 Drawing Sheets

ATOMIZATION CORE DEVICE AND ELECTRONIC CIGARETTE

TECHNICAL FIELD

The present disclosure relates to the field of smoking simulation technology, and more particularly, to an atomization core device and an electronic cigarette having the atomization core device.

BACKGROUND

Presently, electronic cigarettes have become more mature substitutes for the cigarette in the market. When the heating unit in the atomizer is powered by a battery, the heating unit can be electrically driven to heat the tobacco liquid to produce smoke, therefore users can get a smoking experience.

However, for the atomization core of the existing electronic cigarette, air flows inside the atomization core, and liquid enters from the outer surface of the atomization core, so it is easy to cause carbon deposition due to small heating space for the heating wire, and the incense created by the tobacco liquid tends to be distorted since the temperature rise is too fast in a short time. In addition, the liquid inlet area is too large to control the liquid inlet rate, so it is easy to cause problems such as dry heating or leakage.

SUMMARY

In view of the above, in order to cater to the needs of the market, an objective of the present disclosure is to provide an atomization core device which can reduce carbon deposition, increase the life of the heating wire, keep the original taste of the tobacco liquid and reduce the probability of parching and leakage.

In order to achieve the above objective, an atomization core device is provided, including an electrode column, a liquid guiding element and a heating wire. The electrode column is provided with a hollow liquid storage chamber, and a peripheral wall of the electrode column is provided with a through-hole communicating with the liquid storage chamber, and the liquid guiding element and the heating wire wrap around the outer periphery of the electrode column, and the liquid guiding element covers the through-hole.

Furthermore, the electrode column includes a base portion and an extension portion connected to a top end of the base portion, and a bottom end of the base portion is open, a plurality of notches are arranged around a periphery of the bottom end of the base portion, a top end of the extension portion is closed, and the through-hole is arranged on a peripheral wall of the extension portion.

Furthermore, the atomization core device further includes an insulation ring and a cover, the insulation ring is arranged on the base portion, and the cover is arranged on an outer periphery of the insulation ring.

Furthermore, the outer peripheral of the bottom end of the base portion is provided with a peripheral edge extending laterally to form a stepped portion, an outer peripheral side of the bottom end of the insulation ring is provided with a peripheral edge extending laterally to form a stepped groove, the insulation ring is arranged on the base portion of the electrode column and abuts against the stepped portion, the cover is arranged on the outer periphery of the insulation ring, and the bottom end of the cover abuts against the stepped groove of the insulation ring.

Furthermore, the atomization core device includes an electrical conductor arranged in the cover and electrically connected to one end of the heating wire, the electrical conductor electrically connect the heating wire and the cover, and the other end of the heating wire is electrically connected to the electrode column.

Furthermore, the conductor includes a cover plate and an annular wall formed on a peripheral side of the cover plate, the cover plate of the conductor covers on the top of the heating wire and is electrically connected to the heating wire, and the annular wall of the conductor abuts against an inner peripheral surface of the cover.

Furthermore, the atomization core device includes an inner vent pipe, the inner vent pipe is mounted in the cover and arranged outside of the heating wire, and an air gap is arranged between the bottom end of the inner vent pipe and the insulation ring.

Furthermore, the cover includes a top wall, the top wall is provided with an air outlet hole communicating with the inner vent pipe, and the top wall is provided with an air inlet hole used for external air to enter into a passage between an outer wall of the inner vent pipe and the inner peripheral surface of the cover.

Furthermore, the atomization core device includes an air guiding pipe for cooperating with the inner vent pipe, and the air guiding pipe passes through the air outlet hole at the top wall and is in a threaded connection with a top end of the inner vent pipe.

In addition, the present disclosure further provides an electronic cigarette including the atomization core device.

Compared with the prior art, the atomization core according to the present disclosure can reduce the carbon deposition, increase the life of the heating wire, keep the original taste of the tobacco liquid, and reduce the probability of dry heating and leakage.

The preferred embodiment of the present invention and its beneficial effects will be further described in detail with reference to specific embodiments.

DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DESCRIPTION OF REFERENCE SIGNS

Figure 1:
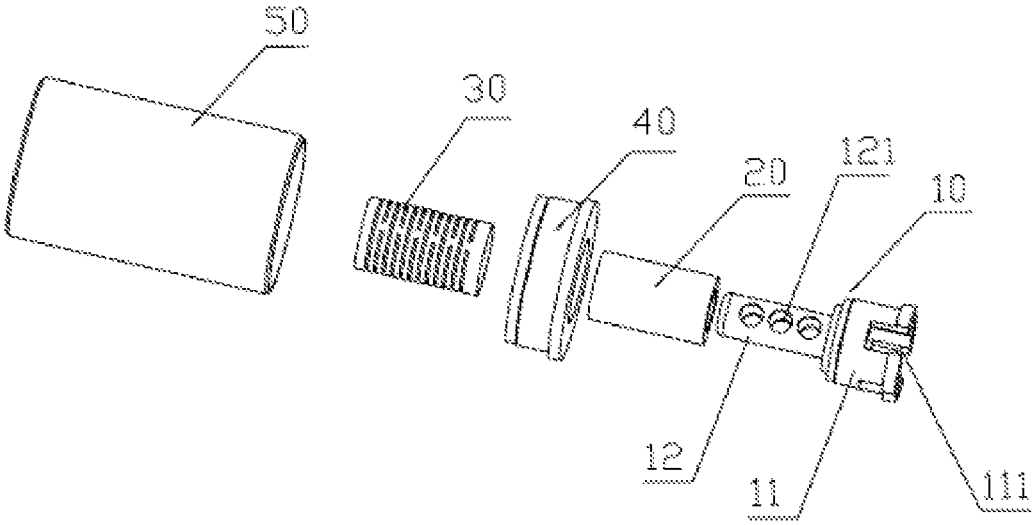
FIG. 1 is an exploded view of an atomization core device according to a first embodiment of the present disclosure.

10: electrode column
11: base portion
12: extension portion
20: liquid guiding element
30: heating wire
40: insulation ring
41: stepped groove

50: cover
51: peripheral wall
52: top wall
60: electrical conductor
61: cover plate
62: annular wall
70: inner vent pipe
80: air guiding pipe
111: notch
112: stepped portion
121: through-hole
521: air inlet hole

DETAILED DESCRIPTION

In the following description of embodiments, reference is made to the accompanying drawings which form a part hereof, and in which it is shown by way of illustration specific embodiments of the disclosure that can be practiced. It is to be understood that other embodiments can be used and structural changes can be made without departing from the scope of the disclosed embodiments.

First Embodiment

Figure 2:
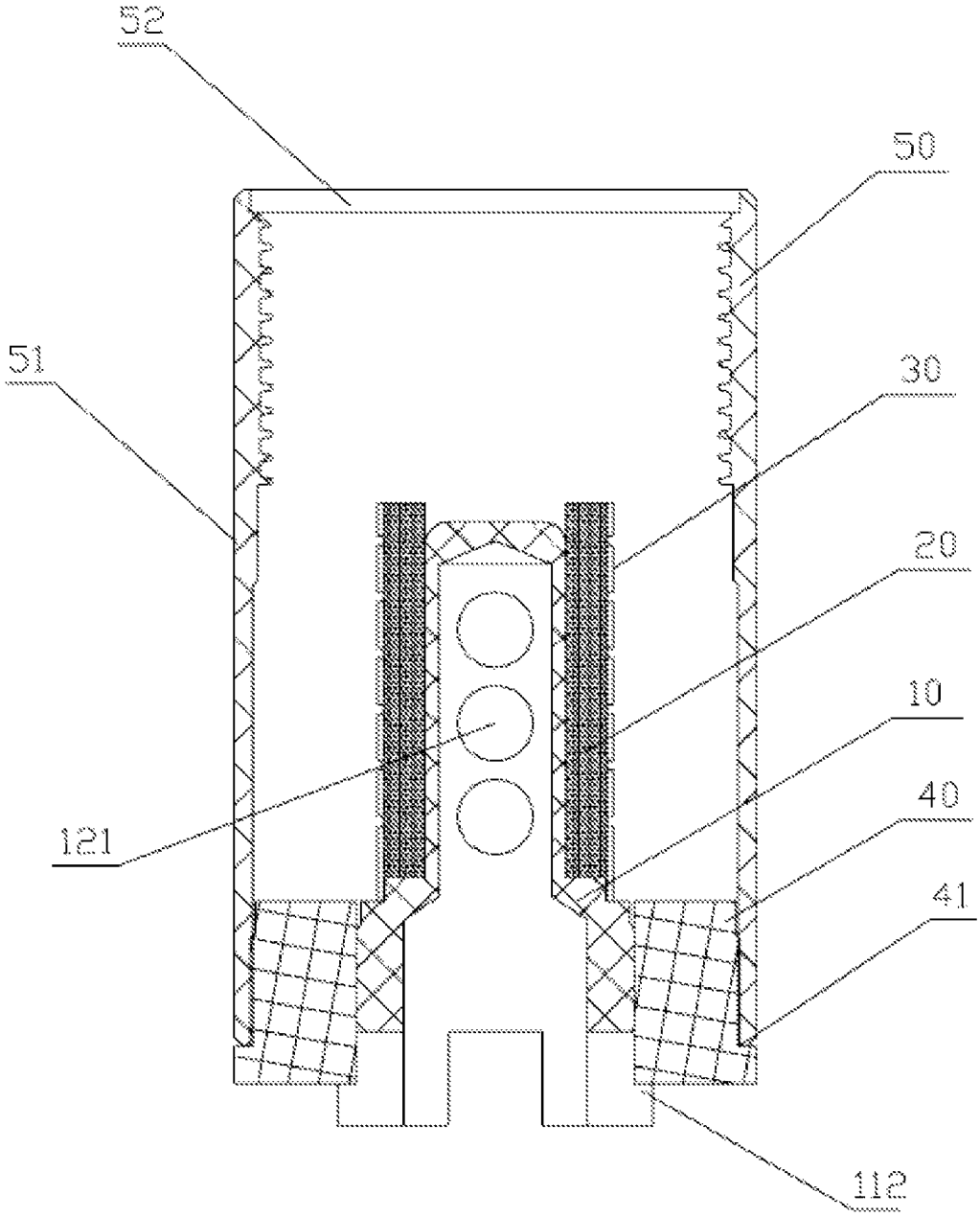
FIG. 2 is a sectional view of the assembled atomization core device as shown in FIG. 1.

With reference to FIGS. 1 and 2, an atomization core device according to the first embodiment of the present disclosure includes an electrode column 10, a liquid guiding element 20 and a heating wire 30. The liquid guiding element 20 and the heating wire 30 wrap around the outer periphery of the electrode column 10.

The electrode column 10 is in a shape of a hollow cylinder with a convex, in which the bottom end is open and the top end is closed, to form a hollow liquid storage chamber. The electrode column 10 includes a base portion 11 and an extension portion 12 connected to the top end of the base portion 11. The bottom end of the base portion 11 is open, a plurality of notches 111 are arranged around the periphery of the bottom end of the base portion 11, and an outer peripheral side of the bottom end of the base portion 11 is provided with a peripheral edge extending laterally to form a stepped portion 112. The liquid is transported into the liquid storage chamber through the opening and the notches 111 at the bottom of the base portion 11. The diameter of the extension portion 12 is smaller than the diameter of the base portion 11, and the top end of the extension portion 12 is closed. A through-hole 121 is formed in the peripheral wall of the extension portion 12 to communicate with the liquid storage chamber. The through-hole 121 can be a circular through-hole, and it is understood that the through-hole 121 may be other shapes, such as square, triangular, and so on. There may be 2-10 through-holes, with an unfixed arrangement. For example, the through-holes may be arranged vertically and symmetric with respect to a central axis, or may be arranged in double thread lines.

The liquid guiding element 20 wraps around the outer periphery of the extension portion 12 and covers the entire through-holes 121. The heating wire 30 is provided on the outer periphery of the liquid guiding element 20. It is to be understood that the heating wire 30 may wrap around the liquid guiding element 20, or the heating wire 30 may be wrapped by the liquid guiding element 20. The liquid guiding element 20 is made of one of liquid guiding cotton, fiber rope and other porous flexible components.

Furthermore, the atomization core device further includes an insulation ring 40 and a cover 50. The insulation ring 40 is provided on the base portion 11 of the electrode column 10, and abuts against the stepped portion 112. An outer peripheral side of the bottom end of the insulation ring 40 is provided with a peripheral edge extending laterally to form a stepped groove 41. The cover 50 is in a shape of a tubular cover, which covers the electrode column 10, the liquid guiding element 20, and the heating wire 30. The cover 50 includes a peripheral wall 51 and a top wall 52 formed at the top end of the peripheral wall 51. The peripheral wall 51 is arranged around the outer periphery of the insulation ring 40, and the bottom end of the peripheral wall 51 abuts against the stepped groove 41 of the insulation ring 40.

When the atomization core device is to be used, the electrode column 10 can be connected to the anode of the power supply. The electrode column 10 can be regarded as a positive electrode column. One end of the heating wire 30 is connected to the electrode column 10, and the other end of the heating wire 30 is connected to the cathode of the power supply. The tobacco liquid enters the liquid storage chamber through the opening or notches 111 of the bottom of the electrode column 10, and then is stored in the liquid storage chamber, and then passes through the through-hole 121 to the liquid guiding element 20. The heating wire 30 may be heated to atomize the tobacco liquid on the liquid guiding element 20, and the smoke created by the atomized tobacco liquid may sucked into the mouth. The path of the tobacco liquid of the atomization core device according to the present disclosure is from the inside to the outside. In contrast, in a conventional way, the tobacco liquid passes through the through-hole of the positive electrode column to the liquid guiding element, so the path is from the outside to the inside. The atomization core device according to the present disclosure can reduce the carbon deposition, increase the life of the heating wire, keep the original taste of the tobacco liquid, and reduce the probability of dry heating and leakage. The electrode column 10 of the atomization core device according to the present disclosure serves not only as the conductive electrode but also as the liquid guiding rod.

Second Embodiment

Figure 3:
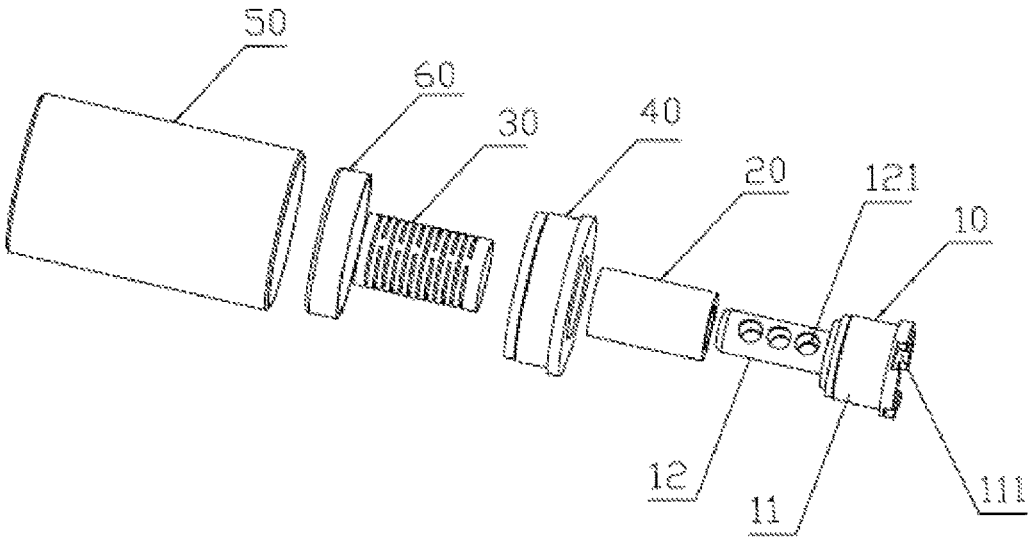
FIG. 3 is an exploded view of an atomization core device according to a second embodiment of the present disclosure.
Figure 4:
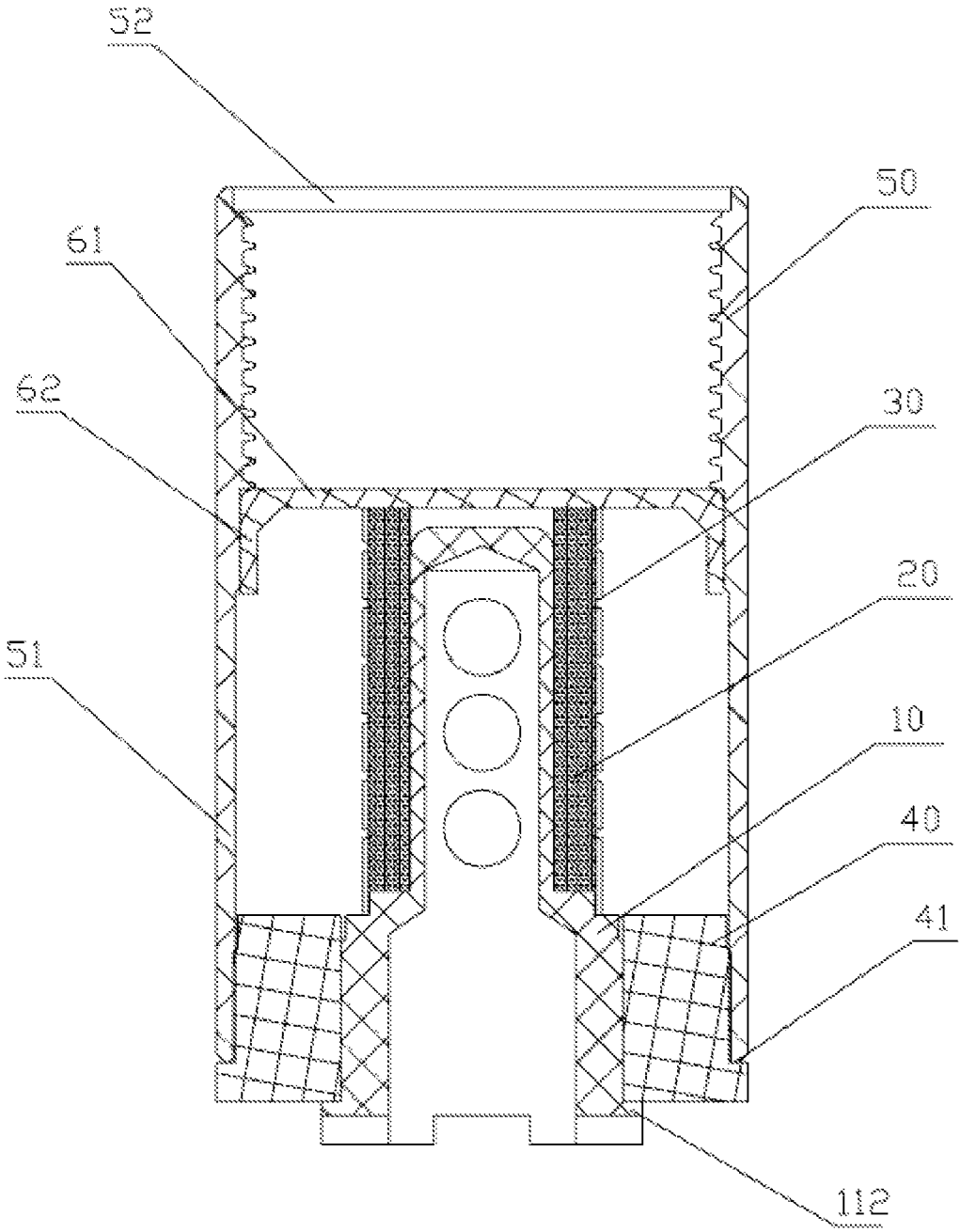
FIG. 4 is a sectional view of the assembled atomization core device as shown in FIG. 3.

As shown in FIGS. 3 and 4, in this embodiment, the atomization core device is different from that in the first embodiment in that the atomization core device in this embodiment further includes a conductor 60. In the case where the electrode column 10 is used to be connected to the anode of the power supply, the conductor 60 is regarded as a negative electrode guide, one end of the heating wire 30 is connected to the electrode column 10, and the other end of the heating wire 30 is connected to the conductor 60. In this embodiment, the conductor 60 is in a shape of a cover, including a cover plate 61 and an annular wall 62 formed on the peripheral side of the cover plate 61. The conductor 60 is housed in the cover 50, and the cover plate 61 of the conductor 60 covers on the top end of the heating wire 30 and is electrically connected to the heating wire 30. The annular wall 62 of the conductor 60 abuts against the inner side of the peripheral wall 51 of the cover 50, so that the conductor 60 electrically connects the cover 50 to the one end of the heating wire 30. The cover 50 may be connected to the cathode of the power supply, and the cover 50 is insulated from the electrode column 10 connected to the anode by the insulation ring 40.

It can be appreciated that the conductor 60 may be omitted, and the pin of the heating wire 30 may be connected to the cover 50 directly or connected to the cathode of the power supply. In this way, it not only saves space and increases air flow, but also stabilizes the resistance.

Third Embodiment

Figure 5:
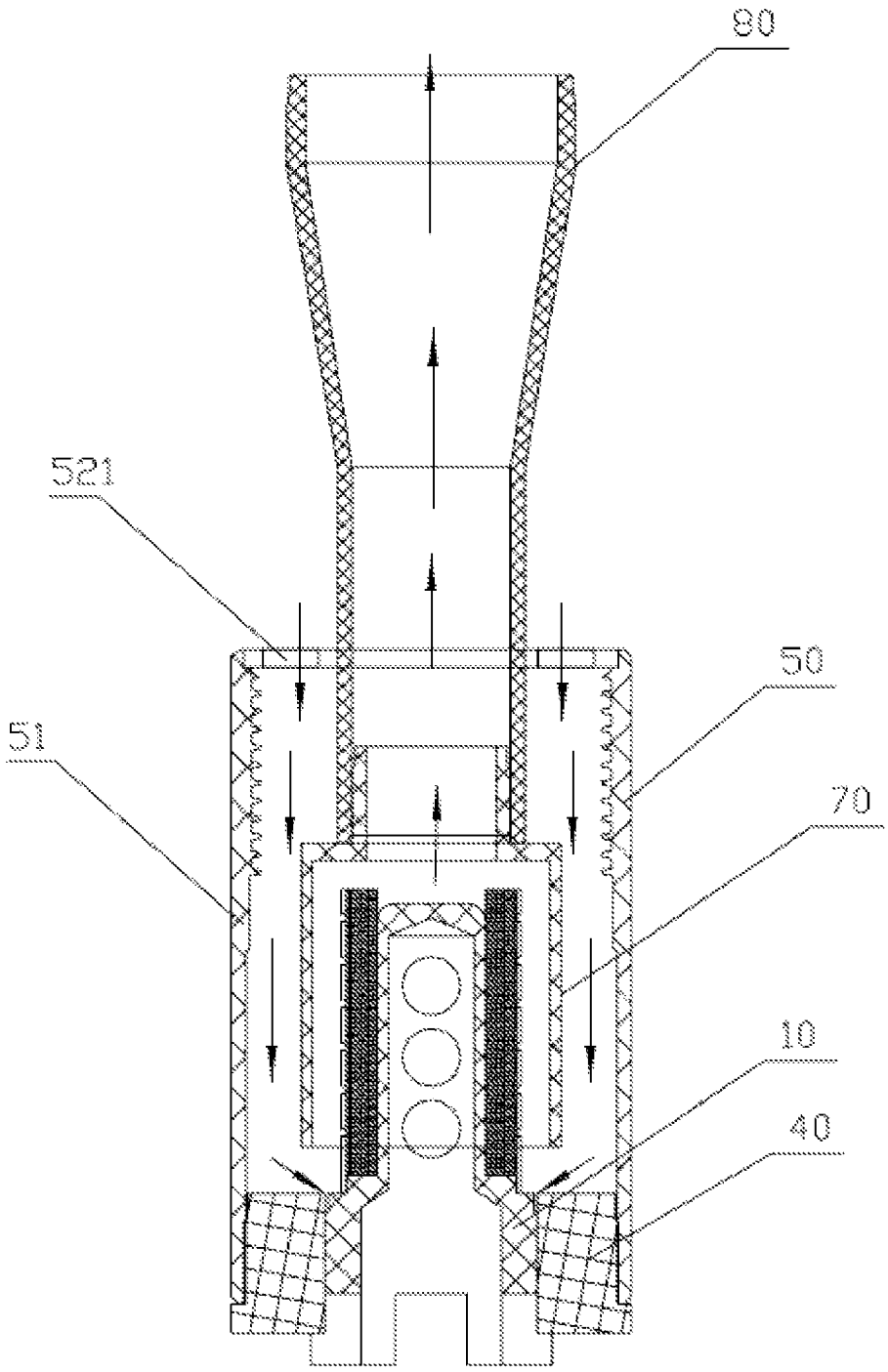
FIG. 5 is a sectional view of an atomization core device according to a third embodiment of the present disclosure.

As shown in FIG. 5, the atomization core device in the third embodiment is different from that in the first embodiment in that the atomization core device in the third embodiment further includes an inner vent pipe 70. The inner vent pipe 70 is used to separate the inlet air and outlet air. The inner vent pipe 70 is mounted into the cover 50 and is arranged outside of the heating wire 30. An air gap is arranged between the bottom end of the inner vent pipe 70 and the insulation ring 40, so that the airflow outside the inner vent pipe 70 can enter into the inner air pipe 70 by passing through the bottom end of the inner air pipe 70. The top end of the inner vent pipe 70 can be directly connected to the top wall 52 of the cover 50, and an air outlet hole (not shown) communicating with the inner vent pipe 70 is provided on the top wall 52 correspondingly. An air inlet hole 521 is provided on the top wall 52, and air can enter into the passage between the outer side of the inner vent pipe 70 and the inner side of the peripheral wall 51 of the cover 50 through the air inlet hole 521. As a result, when the atomization core device is atomizing, the external air flow enters into the passage between the outer side of the inner vent pipe 70 and the inner side of the peripheral wall 51 of the cover 50 through the air inlet hole 521, and through the bottom end of the inner vent pipe 70 into the inner side of the inner vent pipe 70 to drive the atomized smoke to be directly discharged from the air outlet hole on the top wall 52 along the inner vent pipe 70. In this embodiment, the inner vent pipe 70 is not directly fastened to the top wall 52. The atomization core device further includes an air guiding pipe 80 engaged with the inner vent pipe 70, and the air guiding pipe 80 passes through the air outlet hole of the top wall 52 to be connected to the top end of the inner vent pipe 70, more specifically, the top end of the inner vent pipe 70 forms a joint with a smaller radial dimension than that of the inner vent pipe 70. The outer periphery of the joint is formed with a thread, and the inner periphery of the lower end of the air guiding pipe 80 is formed with a thread, so that the air guiding pipe 80 can be in threaded connection with the joint of the inner vent pipe 70. It can be appreciated that the air guiding pipe 80 may be connected (e.g., screwed) to the housing of the atomizer (not shown) so that the inner vent pipe 70 is integrally fixed with the air guiding pipe 80. In addition, the air guiding pipe 80 can be directly attached to the top wall 52 of the cover 50. By providing the inner vent pipe 70 and the air guiding pipe 80, the user's mouth can face the air outlet hole exactly, which brings a better experience for the user, and the air inlet hole 521 is provided on the periphery of the air outlet hole to achieve that the air can enter into the inner vent pipe 70 from the outside and exit out of the inner vent pipe 70 from the inside. It can be appreciated that a pair of symmetrical air inlet holes 521 are provided on both sides of the air outlet hole.

In conclusion, in the atomization core device described in the present disclosure, an liquid storage chamber is provided in the electrode column 10, a through-hole 121 is formed in the peripheral wall of the electrode column 10 to communicate with the liquid storage chamber, and the liquid guiding element 20 and the heating wire 30 wrap around the outer periphery of the electrode column 10. During atomization, the tobacco liquid in the liquid storage chamber passes through the through-hole 121 to reach the liquid guiding element 20, and the heating wire 30 is heated to atomize the tobacco liquid, so that the smoke created by the atomized tobacco liquid can be sucked into the mouth. In such tobacco liquid guiding path from inside to outside, it can reduce the carbon deposition, increase the life of the heating wire, keep original taste of tobacco liquid, and reduce the probability of dry heating and leakage. The electronic cigarette with the atomization core device has the advantageous effects as described above correspondingly.

The embodiments are chosen and described in order to explain the principles of the disclosure and their practical application so as to activate others skilled in the art to utilize the disclosure and various embodiments. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An atomization core device, comprising an electrode column, a liquid guiding element and a heating wire, wherein the electrode column is provided with a hollow liquid storage chamber, and a peripheral wall of the electrode column is provided with a through-hole in communication with the liquid storage chamber, and the liquid guiding element and the heating wire wrap around an outer periphery of the electrode column, and the liquid guiding element covers the through-hole.

2. The atomization core device of the claim 1, wherein the electrode column includes a base portion and an extension portion connected to a top end of the base portion, a bottom end of the base portion is open, a plurality of notches are arranged around a periphery of the bottom end of the base portion, a top end of the extension portion is closed, and the through-hole is arranged on a peripheral wall of extension portion.

3. The atomization core device of the claim 2, further comprising an insulation ring and a cover, the insulation ring is arranged on the base portion, and the cover is provided on an outer periphery of the insulation ring.

4. The atomization core device of claim 3, wherein an outer peripheral side of the bottom end of the base portion is provided with a peripheral edge extending laterally to form a stepped portion, an outer peripheral side of a bottom end of the insulation ring is provided with a peripheral edge extending laterally to form a stepped groove, the insulation ring is arranged on the base portion of the electrode column and abuts against the stepped portion, and the cover is provided on the outer periphery of the insulation ring, and a bottom end of the cover abuts against the stepped groove of the insulation ring.

5. The atomization core device of claim 3, further comprising an electrical conductor arranged in the cover and electrically connected to one end of the heating wire, the electrical conductor is electrically connected the heating wire and the cover, and the other end of the heating wire is electrically connected to the electrode column.

6. The atomization core device of claim 5, wherein the electrical conductor includes a cover plate and an annular wall formed on a peripheral side of the cover plate, the cover plate of the electrical conductor covers on the top of the heating wire and is electrically connected to the heating wire, and the annular wall of the electrical conductor abuts against an inner peripheral surface of the cover.

7. The atomization core device of claim 3, further comprising an inner vent pipe, the inner vent pipe is mounted in the cover and arranged outside of the heating wire, and an air gap is arrange between a bottom end of the inner vent pipe and the insulation ring.

8. The atomization core device of claim 7, wherein the cover includes a top wall, the top wall is provided with an air outlet hole communicating with the inner vent pipe, and the top wall is provided with an air inlet hole used for external air to enter into a passage between an outer wall of the inner vent pipe and the inner peripheral surface of the cover.

9. The atomization core device of claim 8, further comprising an air guiding pipe for cooperating with the inner vent pipe, and the air guiding pipe passes through the air outlet hole at the top wall and is in a threaded connection with a top end of the inner vent pipe.

10. An electronic cigarette, comprising the atomization core device of claim 1.

11. The electronic cigarette of claim 10, wherein, in the atomization core device, the electrode column includes a base portion and an extension portion connected to a top end of the base portion, a bottom end of the base portion is open, a plurality of notches are arranged around a periphery of the bottom end of the base portion, a top end of the extension portion is closed, and the through-hole is arranged on a peripheral wall of extension portion.

12. The electronic cigarette of claim 11, wherein the atomization core device further comprises an insulation ring and a cover, the insulation ring is arranged on the base portion, and the cover is provided on an outer periphery of the insulation ring.

13. The electronic cigarette of claim 12, wherein an outer peripheral side of the bottom end of the base portion is provided with a peripheral edge extending laterally to form a stepped portion, an outer peripheral side of a bottom end of the insulation ring is provided with a peripheral edge extending laterally to form a stepped groove, the insulation ring is arranged on the base portion of the electrode column and abuts against the stepped portion, and the cover is provided on the outer periphery of the insulation ring, and a bottom end of the cover abuts against the stepped groove of the insulation ring.

14. The electronic cigarette of claim 12, wherein the atomization core further comprises an electrical conductor arranged in the cover and electrically connected to one end of the heating wire, the electrical conductor is electrically connected the heating wire and the cover, and the other end of the heating wire is electrically connected to the electrode column.

15. The electronic cigarette of claim 14, wherein the electrical conductor comprises a cover plate and an annular wall formed on a peripheral side of the cover plate, the cover plate of the electrical conductor covers on the top of the heating wire and is electrically connected to the heating wire, and the annular wall of the electrical conductor abuts against an inner peripheral surface of the cover.

16. The electronic cigarette of claim 12, wherein the atomization core further comprises an inner vent pipe, the inner vent pipe is mounted in the cover and arranged outside of the heating wire, and an air gap is arrange between a bottom end of the inner vent pipe and the insulation ring.

17. The electronic cigarette of claim 16, wherein the cover includes a top wall, the top wall is provided with an air outlet hole communicating with the inner vent pipe, and the top wall is provided with an air inlet hole used for external air to enter into a passage between an outer wall of the inner vent pipe and the inner peripheral surface of the cover.

18. The electronic cigarette of claim 17, wherein the atomization core further comprises an air guiding pipe for cooperating with the inner vent pipe, and the air guiding pipe passes through the air outlet hole at the top wall and is in a threaded connection with a top end of the inner vent pipe.

* * * * *